US009353984B2

(12) United States Patent
Kim et al.

(10) Patent No.: US 9,353,984 B2
(45) Date of Patent: May 31, 2016

(54) REFRIGERATOR HAVING DOUBLE DOORS

(71) Applicant: SAMSUNG ELECTRONICS CO., LTD., Suwon-si, Gyeonggi-do (KR)

(72) Inventors: Byoung Mok Kim, Kwangju (KR); Seong Woo Kim, Anyang-si (KR); Jae Hak Kim, Kwangju (KR); Seung Yong Yang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 16 days.

(21) Appl. No.: 14/186,714

(22) Filed: Feb. 21, 2014

(65) Prior Publication Data

US 2014/0232251 A1 Aug. 21, 2014

(30) Foreign Application Priority Data

Feb. 21, 2013 (KR) ..... 10-2013-0018338

(51) Int. Cl.

| | |
|---|---|
| ***A47B 96/04*** | (2006.01) |
| ***F25D 23/02*** | (2006.01) |
| *E05C 7/02* | (2006.01) |

(52) U.S. Cl.

CPC ..... *F25D 23/028* (2013.01); *F25D 23/025* (2013.01); *E05C 7/02* (2013.01); *F25D 2323/023* (2013.01)

(58) Field of Classification Search

CPC ..... E05C 7/06

USPC ..... 312/215, 222, 405; 292/194, 224, 227, 292/95

See application file for complete search history.

(56) References Cited

U.S. PATENT DOCUMENTS

| | | | | |
|---|---|---|---|---|
| 1,954,500 | A * | 4/1934 | Sparks | 292/127 |
| 2,129,923 | A * | 9/1938 | Frankel | F25D 11/02 126/197 |
| 2,777,722 | A * | 1/1957 | Burke | E05B 65/0046 292/332 |
| 2,859,744 | A | 11/1958 | Hadley | |
| 3,204,994 | A * | 9/1965 | Jacobi | E05B 83/30 292/227 |
| 4,302,907 | A | 12/1981 | Canals et al. | |
| 2006/0150661 | A1 | 7/2006 | Kim et al. | |
| 2013/0026900 | A1 | 1/2013 | Oh et al. | |
| 2013/0170897 | A1 * | 7/2013 | Kang et al. | 403/321 |

FOREIGN PATENT DOCUMENTS

| | | | |
|---|---|---|---|
| EP | 2 613 112 | A2 | 7/2013 |
| JP | 2011-69612 | | 4/2011 |
| KR | 100285986 | * | 1/2001 |
| KR | 20-2009-0004606 | | 5/2009 |
| KR | 10-2010-0008271 | | 1/2010 |
| KR | 10-2012-0063316 | | 6/2012 |

OTHER PUBLICATIONS

European Search Report issued May 15, 2015 in corresponding European Patent Application No. 14154264.7.

European Office Action mailed Feb. 8, 2016 in corresponding European Patent Application No. 14154264.7.

* cited by examiner

*Primary Examiner* — Matthew Ing

(74) *Attorney, Agent, or Firm* — Staas & Halsey LLP

(57) ABSTRACT

A refrigerator includes a first door that is rotatably provided so as to open/close a storage compartment, a second door that is rotatably provided in the front of the first door so as to open/close the first door, and a door anti-opening unit that prevents or allows opening of the second door depending on whether the first door is opened or closed. The door anti-opening unit prevents the second door from being unintentionally opened when the first door is opened.

19 Claims, 14 Drawing Sheets

REFRIGERATOR HAVING DOUBLE DOORS

CROSS-REFERENCE TO RELATED APPLICATIONS

This application claims the benefit of Korean Patent Application No. 10-2013-0018338, filed on Feb. 21, 2013 in the Korean Intellectual Property Office, the disclosure of which is incorporated herein by reference.

BACKGROUND

1. Field

One or more embodiments relate to a refrigerator that may have a first door that may be rotatably provided so as to open/close a storage compartment and may have an opening, at least one door pocket that may be provided in the opening, and a second door that may be rotatably provided so as to open/close the opening.

2. Description of the Related Art

In general, a refrigerator is a household appliance that is equipped with a storage compartment storing foodstuffs and a cooled air supply system supplying cooled air to the storage compartment and stores the foodstuffs for a long time in a fresh state.

The storage compartment is equipped with shelves on which the foodstuffs can be placed. The storage compartment is provided so that the front thereof is opened so as to be able to take in or out foodstuffs, and the front of the storage compartment may be opened/closed by a first door that is rotatably coupled to a main body. Door pockets capable of storing foodstuffs apart from the shelves disposed in the storage compartment may be provided in the rear of the first door.

Since these door pockets are provided in the rear of the first door, it is generally possible to get access to the door pockets only when the first door is opened. Meanwhile, there is a refrigerator in which the first door is provided with a separate second door so as to be able to get access to the door pockets without opening the first door. The refrigerator having such a second door allows the second door to be opened to get access to the door pockets provided in the rear of the first door without opening the first door. As such, the storage of the foodstuffs can be diversified, and an effect of preserving the cooled air can be achieved.

However, since the second door is limited to a size, only some of the plurality of door pockets vertically provided in the rear of the first door can be accessed.

SUMMARY

The foregoing described problems may be overcome and/or other aspects may be achieved by one or more embodiments of a refrigerator that may include a second door to be opened to get access to a plurality of door pockets provided for a first door without opening the first door.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a refrigerator may include: a main body having a storage compartment; a first door that may be rotatably provided in the front of the main body, may open/close the storage compartment, and may have an opening in which at least one door pocket may be provided; a second door that may be rotatably provided in the front of the first door, may open/close the opening, and may be rotated in the same direction as a rotating direction of the first door; and a door anti-opening unit that may prevent or allow opening of the second door depending on whether the first door is opened or closed.

Here, the door anti-opening unit may allow the second door to be opened in a state in which the first door is closed and prevent the second door from being opened in a state in which the first door is opened.

Further, the door anti-opening unit may include a striker that may be coupled to a lower face of the second door and a latch that may be coupled to a lower face of the first door and may be latched on or unlatched from the striker depending on whether the first door is opened or closed.

Here, the latch may include a working bar that may be pressurized by the main body and performs a linear motion, a rotating bar that may be rotated in cooperation with the linear motion of the working bar and may have a hook at one end thereof, and a restoring spring that may restore the working bar to its original position when pressurization of the main body against the working bar is released.

Here, the rotating bar may include a rotational shaft that may act as the center of rotation and a connecting shaft that may be connected to the working bar, may receive a driving force from the working bar, and may be provided so as to be parallel with the rotational shaft.

Further, the working bar may include a connecting hole into which the connecting shaft of the rotating bar may be rotatably inserted.

Also, the door anti-opening unit may include a housing that may accommodate the working bar, the rotating bar, and the restoring spring.

Here, the housing may be coupled to the lower face of the first door by a fastening member.

Further, the striker may include a coupling plate coupled to the lower face of the second door and an arm bar formed in a ring shape.

Here, the coupling plate may be coupled to the lower face of the second door by a fastening member.

In addition, the striker may be integrally formed of a steel material.

In accordance with one or more embodiments, a refrigerator may include: a main body having a storage compartment; a first door that may be rotatably provided in the front of the main body, nay open/close the storage compartment, and may have an opening in which at least one door pocket may be provided; a second door that may be rotatably provided in the front of the first door, may open/close the opening, and may be rotated in the same direction as a rotating direction of the first door; a first gasket that may be provided on a rear face of the first door so as to maintain airtightness between the main body and the first door and may have a first magnet drawing the main body; and a second gasket that may be provided on a rear face of the second door so as to maintain airtightness between the first door and the second door and may have a second magnet drawing the first door.

Here, the main body may include an outer case, and the outer case of the main body and a front face of the first door may be formed of a steel material so as to be drawn by the first magnet and the second magnet, respectively.

Further, the refrigerator may further include a door anti-opening unit that may prevent the second door from being unintentionally opened by inertia occurring when the first door is opened.

According to one or more embodiments, the second door may be prevented from being unintentionally opened by inertia occurring when the first door is opened.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
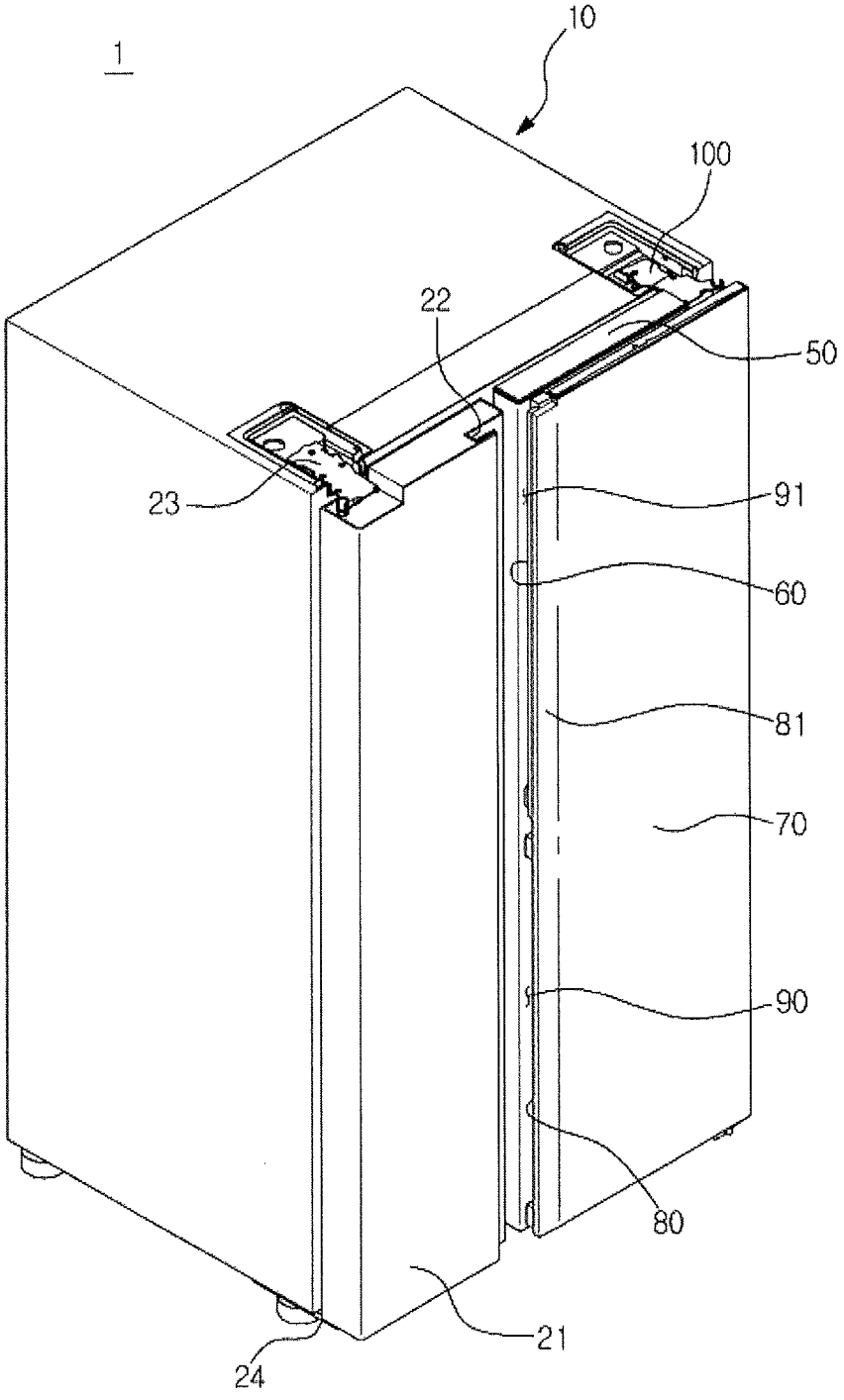
FIG. 1 shows a refrigerator in which first and second doors are all closed in accordance with one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
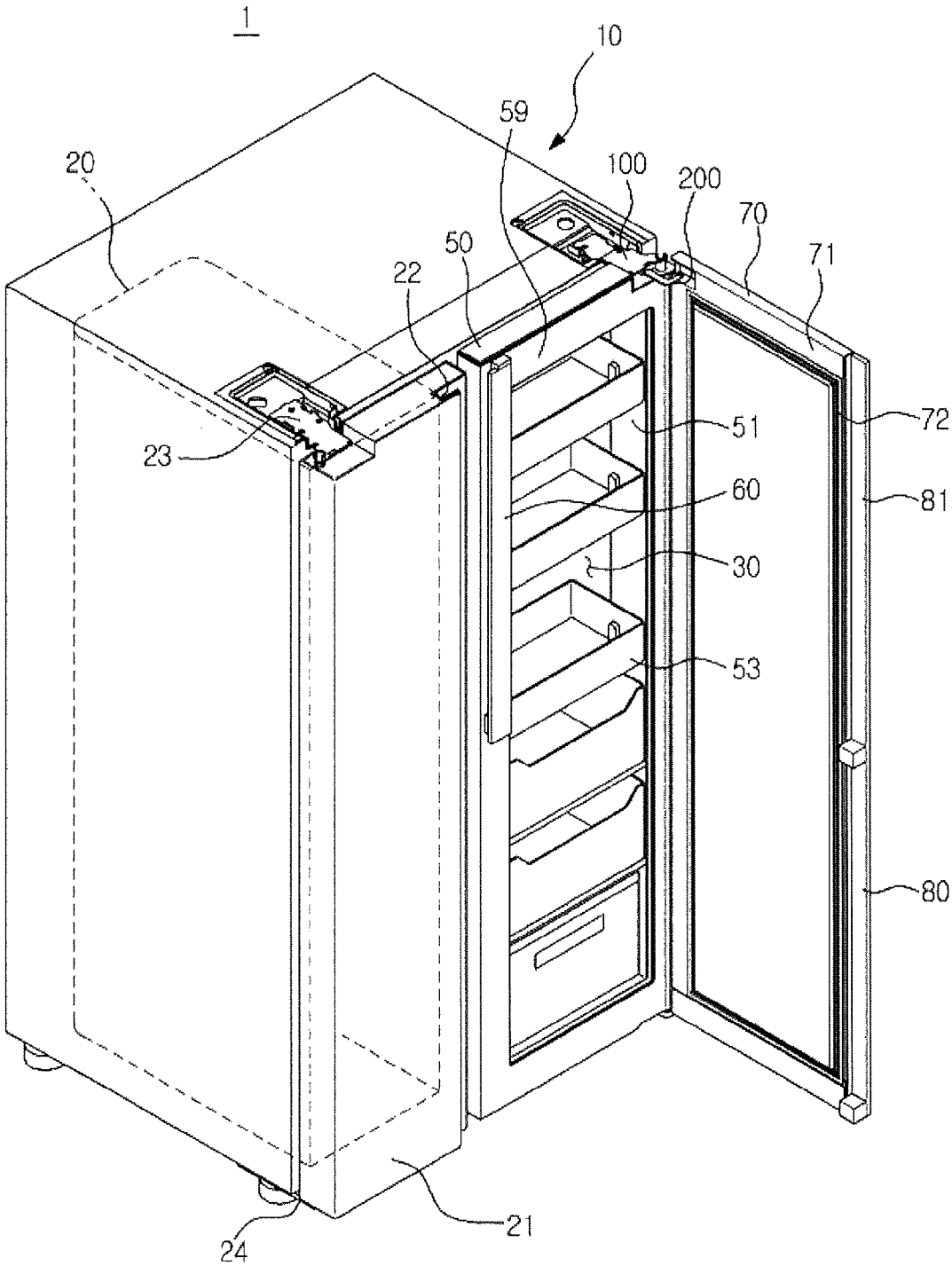
FIG. 2 shows a state in which a second door of a refrigerator according to one or more embodiments, such as the refrigerator of FIG. 1, is open.
Figure 3:
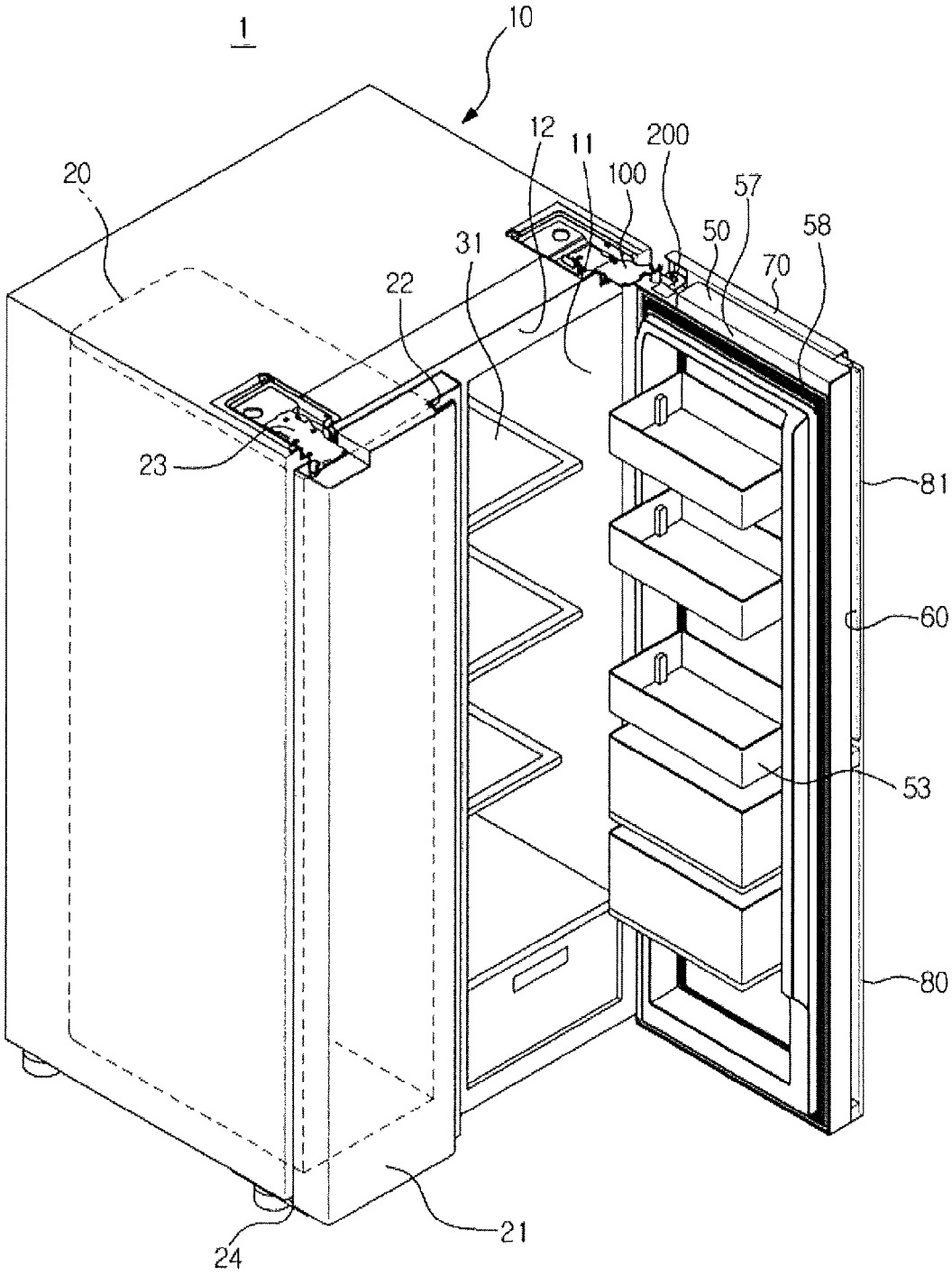
FIG. 3 shows a state in which a first door of a refrigerator according to one or more embodiments, such as the refrigerator of FIG. 1, is open.
Figure 4:
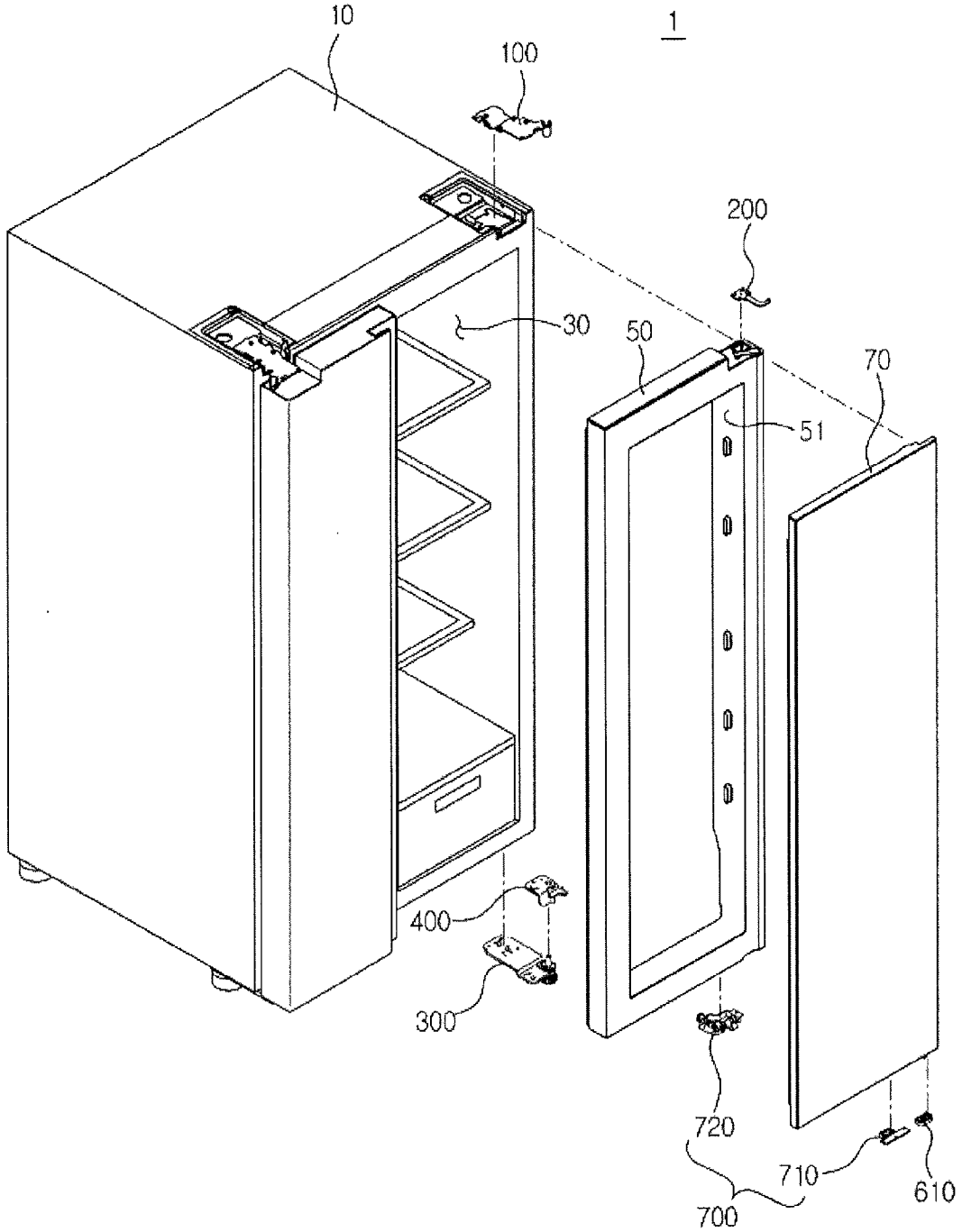
FIG. 4 shows a state in which first and second doors of a refrigerator according to one or more embodiments, such as the refrigerator of FIG. 1, are separated.
Figure 14:
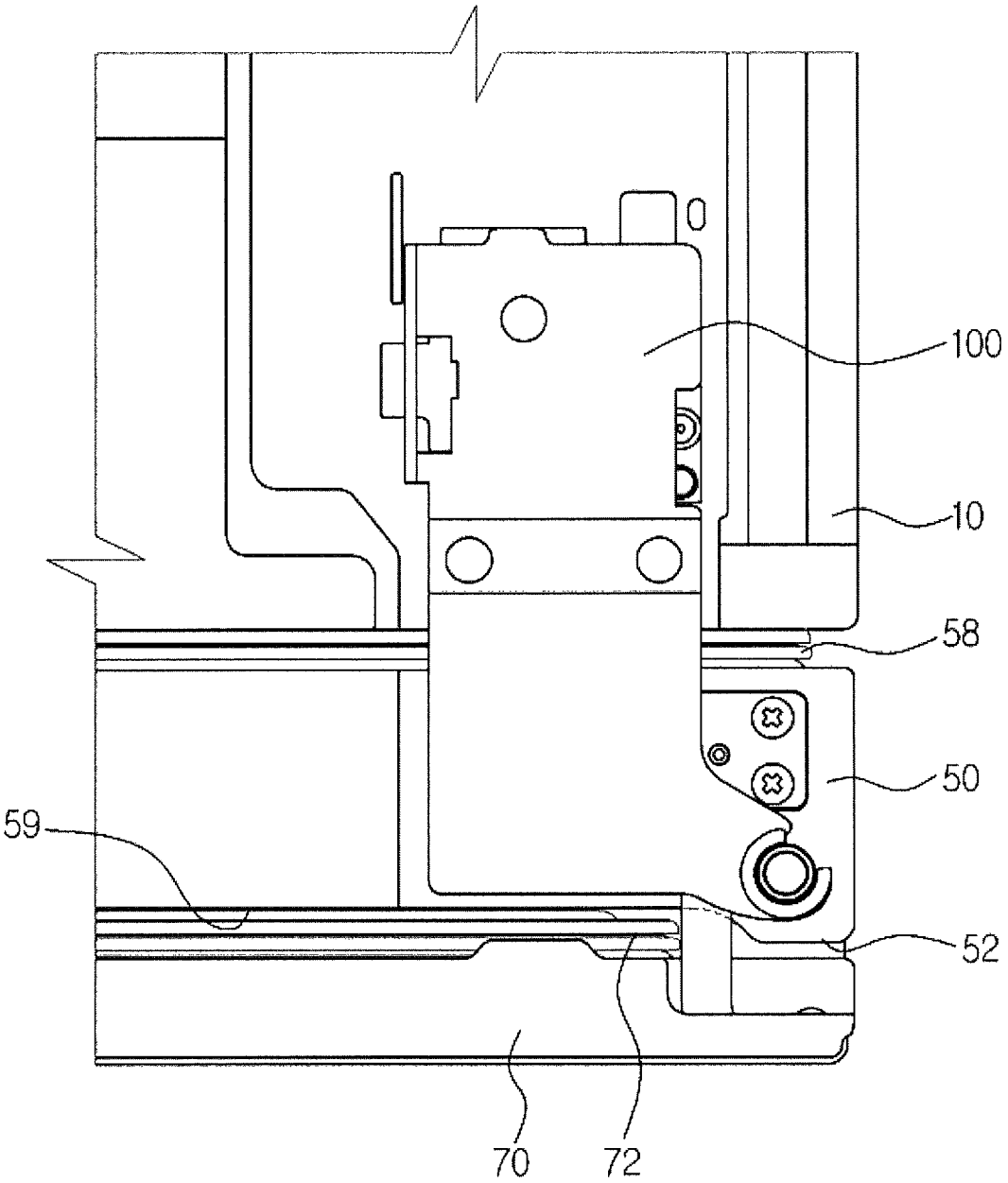
FIG. 14 is a plan view of a refrigerator according to one or more embodiments, such as the refrigerator of FIG. 1, when viewed from the top.

FIG. 1 shows a refrigerator in which first and second doors are all closed in accordance with one or more embodiments. FIG. 2 shows a state in which a second door of a refrigerator according to one or more embodiments, such as the refrigerator of FIG. 1, is open. FIG. 3 shows a state in which a first door of a refrigerator according to one or more embodiments, such as the refrigerator of FIG. 1, is open. FIG. 4 shows a state in which first and second doors of a refrigerator according to one or more embodiments, such as the refrigerator of FIG. 1, are separated. FIG. 14 is a plan view of a refrigerator according to one or more embodiments, such as the refrigerator of FIG. 1, when viewed from the top.

Referring to FIGS. 1 to 4, a refrigerator 1 according to one or more embodiments may include a main body 10, storage compartments 20 and 30 that may be provided inside the main body 10, and a cooled air supply system that may supply cooled air to the storage compartments 20 and 30.

The main body 10 may include an inner case 11 that may be formed in an approximate box shape and may form the storage compartments 20 and 30, an outer case 12 that may be coupled outside of the inner case 11, and an insulator (not shown) disposed between the inner case 11 and the outer case 12. The inner case 11 may be formed, for example, of a resin material, and the outer case 12 may be formed, for example, of a steel material.

The cooled air supply system may include a compressor (not shown), a condenser (not shown), an expansion valve (not shown), and an evaporator (not shown) and may circulate a refrigerant to generate cooled air using latent heat of evaporation.

The storage compartments 20 and 30 may be partitioned into a left-hand freezing compartment 20 and a right-hand refrigerating compartment 30 by a vertical partition (not shown). However, the freezing compartment 20 and the refrigerating compartment 30 may be switched in position. The refrigerating compartment 30 may be equipped with shelves 31 on which foodstuffs can be placed.

The freezing compartment 20 and the refrigerating compartment 30 may each have an open front face so that foodstuffs can come in or out. The open front face of the freezing compartment 20 may be opened/closed by a freezing compartment door 21, and the open front face of the refrigerating compartment 30 may be opened/closed by a first door 50.

The freezing compartment door 21 may be rotatably installed in the front of the main body 10 and may be provided so as to be able to be rotated around a vertical rotational axis in a leftward/rightward direction. The freezing compartment door 21 may be rotatably supported by upper and lower hinges 23 and 24 that may be coupled to upper and lower faces of the main body 10 respectively.

The first door 50 may also be rotatably installed in the front of the main body 10 and be provided so as to be able to be rotated around a vertical rotational axis in a leftward/rightward direction. The first door 50 may be rotatably supported by first upper and lower hinges 100 and 300 that may be coupled to upper and lower faces of the main body 10 respectively.

A second door 70 may also be rotatably installed in the front of the first door 50 and be provided so as to be able to be rotated in the same direction as the rotating direction of the first door 50. The rotational axes of the first and second doors 50 and 70 may be parallel to each other and thus may be not located on the same axis. The second door 70 may be rotatably supported by second upper and lower hinges 200 and 400 that may be coupled to upper and lower faces of the first door 50 respectively.

The first upper hinge 100, the first lower hinge 300, the second upper hinge 200, and the second lower hinge 400 will be described below in detail with regard to their constitutions.

The freezing compartment door 21 may be provided with a handle 22 which is grasped by the hand so as to be able to open/close the freezing compartment door 21.

The first door 50 and the second door 70 may be provided with a first handle 60 and a second handle 80, respectively. The first handle 60 and the second handle 80 may be provided in parallel in an approximately vertical direction. The first handle 60 may be provided above the second handle 80. Further, the first handle 60 and the second handle 80 may be provided with a first holding recess 91 and a second holding recess 92 capable of holding the hand. The first holding recess 91 and the second holding recess 92 may be provided in parallel in an approximately vertical direction. The first holding recess 91 may be provided above the second holding recess 92.

A user may put his/her hand into the first holding recess 91 to get access to the first handle 60. The user may put his/her hand into the second holding recess 92 to get access to the second handle 80.

Here, a cover 81 covering the first handle 60 may extend above the second handle 80. Thus, when viewed from the front, the first handle 60 may be hidden by the cover 81 and thus may not be exposed.

Meanwhile, the first door 50 may have an opening 51 whose size may be slightly smaller than that of the refrigerating compartment 30. The opening 51 may be provided with at least one door pocket 53 in which foodstuffs can be contained. The foodstuffs that are low and small and frequently come in or out may be generally stored in the door pocket 53. The at least one door pocket 53 may be arranged in the opening 51 in a row in a vertical direction. The door pockets 53 may be mounted on or demounted from the opening 51.

The second door 70 may have an approximately flat panel shape without an opening. Thus, the second door 70 may open/close the opening 51 of the first door 50.

An operation of use of the first and second doors 50 and 70 configured in this way in accordance with one or more embodiments will be described. As shown in FIG. 1, when the first and second doors 50 and 70 are closed, the refrigerating compartment 30 may be tightly sealed, and the cooled air thereof may be preserved.

As shown in FIG. 2, when the second door 70 is opened, a user can get access to at least one door pocket 53 and take foodstuffs into or out of the door pocket 53. Here, the discharge of the cooled air from the refrigerating compartment 30 may be reduced compared to a state in which the first door 50 is opened.

As shown in FIG. 3, when the first door 50 is opened, a user can get access to the refrigerating compartment 30 to take in or out foodstuffs stored in the shelves 31. Of course, here, the user can get access to at least one door pocket 53 and take foodstuffs into or out of the door pocket 53.

In this way, the refrigerator 1 according to one or more embodiments allows the user to take in or out the foodstuffs in various fashions as needed and has an effect capable of minimizing the discharge of the cooled air.

Meanwhile, as shown in FIG. 3, a rear face 57 of the first door may be provided with a first gasket 58 for maintaining airtightness between the first door 50 and the outer case 12 of the main body. Here, the first gasket 58 may be formed, for example, of a rubber material. Further, the first gasket 58 may include a first magnet (not shown) so as to allow the first door 50 to be kept closed by drawing the outer case 12 formed of a steel material.

In addition, as shown in FIG. 2, a rear face 71 of the second door may be provided with a second gasket 72 for maintaining airtightness between the second door 70 and the first door 50. Here, the second gasket 72 may be formed, for example, of a rubber material. Further, the second gasket 72 may include a second magnet (not shown) so as to allow the second door 70 to be kept closed by drawing a front face 59 of the first door formed of a steel material.

In this way, the refrigerator according to one or more embodiments may allow the first and second doors 50 and 70 to be kept closed at normal times by magnetic forces of magnets. Particularly, a magnetic force with which the first magnet (not shown) of the first door 50 draws the outer case 12 of the main body may be stronger than that with which the second magnet (not shown) of the second door 70 draws the first door 50 so that the second door 70 may be not opened along with the first door 50 when opened.

Thus, when a user pulls the second door 70 with a stronger force than the magnetic force with which the second magnet (not shown) of the second door 70 draws the first door 50, the second door 70 can be opened with the first door 50 closed.

Meanwhile, the refrigerator according to one or more embodiments may further include a door anti-opening unit 700 that may prevent the second door 70 from being opened unintentionally by inertia when the first door 50 is opened.

That is, a user may grasp the first handle 60 to open the first door 50. In this process, when the first door 50 is sufficiently opened, the first door 50 may be stopped. Here, when a force of rotational inertia is greater than the magnetic force with which the second magnet (not shown) of the second door 70 draws the first door 50, the second door 70 may be opened unintentionally.

For this reason the first and second doors 50 and 70 may have the same rotating direction. The second door 70 may be connected to the first door 50 by the second upper and lower hinges 200 and 400. In this case, the door anti-opening unit 700 may prevent the second door 70 from being opened. The configuration of the door anti-opening unit 700 will be described in greater detail again.

Meanwhile, as shown in FIG. 14, the first door 50 may be provided with a gasket anti-exposure part 52 at an edge thereof which protrudes forward. The gasket anti-exposure part 52 may improve aesthetics by preventing exposure of the second gasket 72 provided in the rear face of the second door 70. Further, the gasket anti-exposure part 52 may prevent a safety accident from occurring, for instance prevent fingers from being pinched between the first door 50 and the second door 70.

Figure 5:
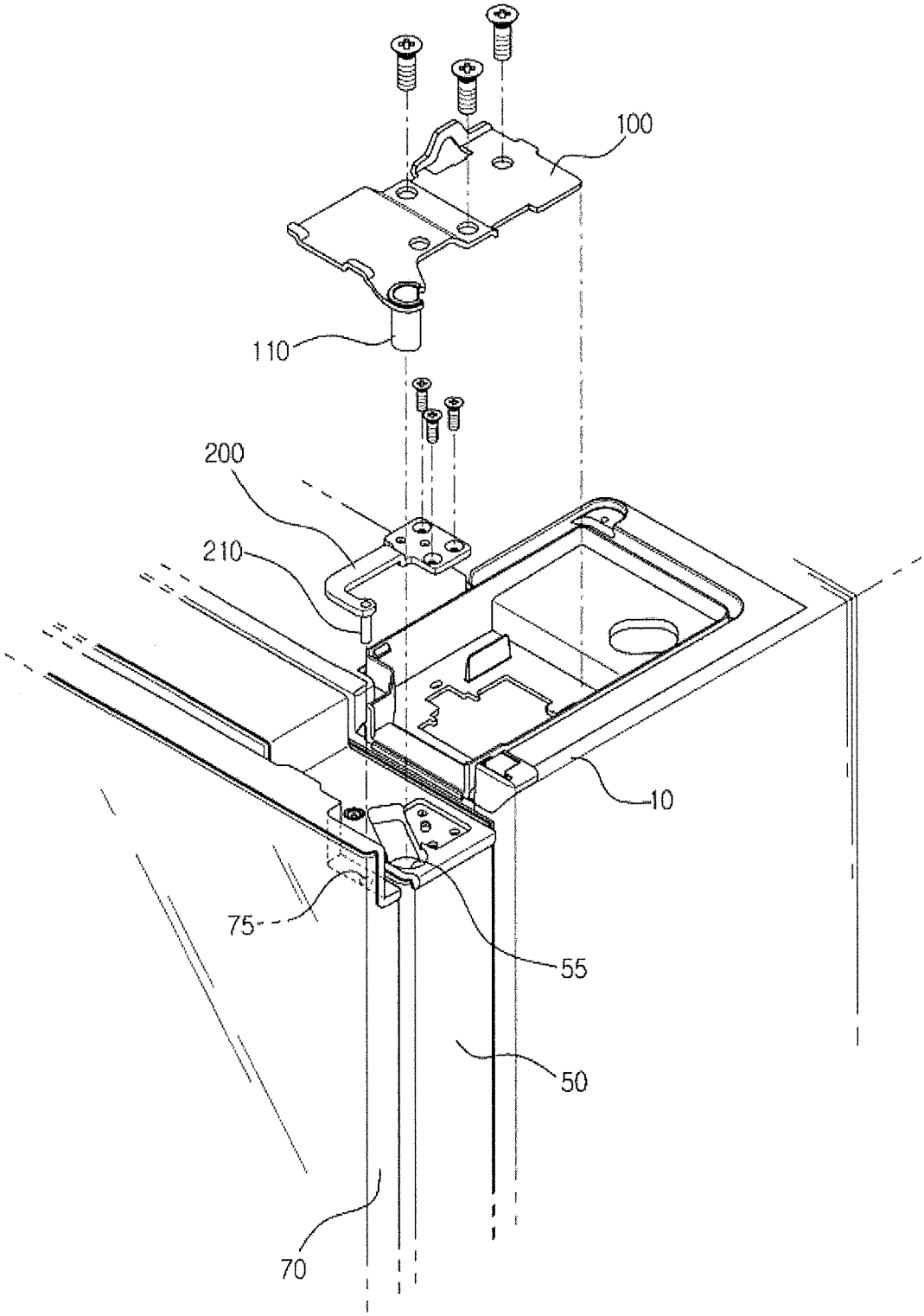
FIG. 5 shows first and second upper hinges of a refrigerator according to one or more embodiments, such as the refrigerator of FIG. 1.
Figure 6:
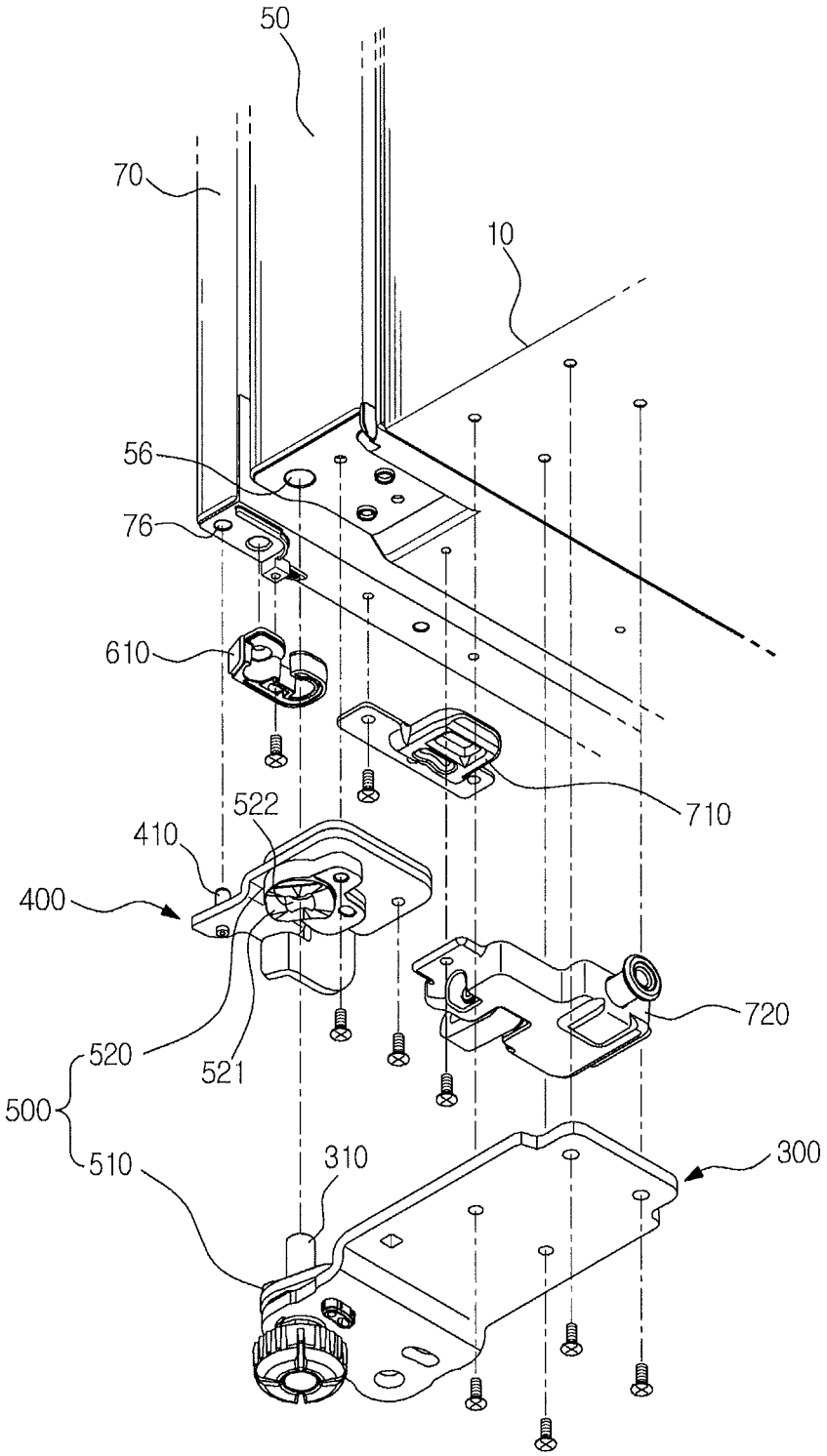
FIG. 6 shows first and second lower hinges of a refrigerator according to one or more embodiments, such as the refrigerator of FIG. 1.
Figure 7:
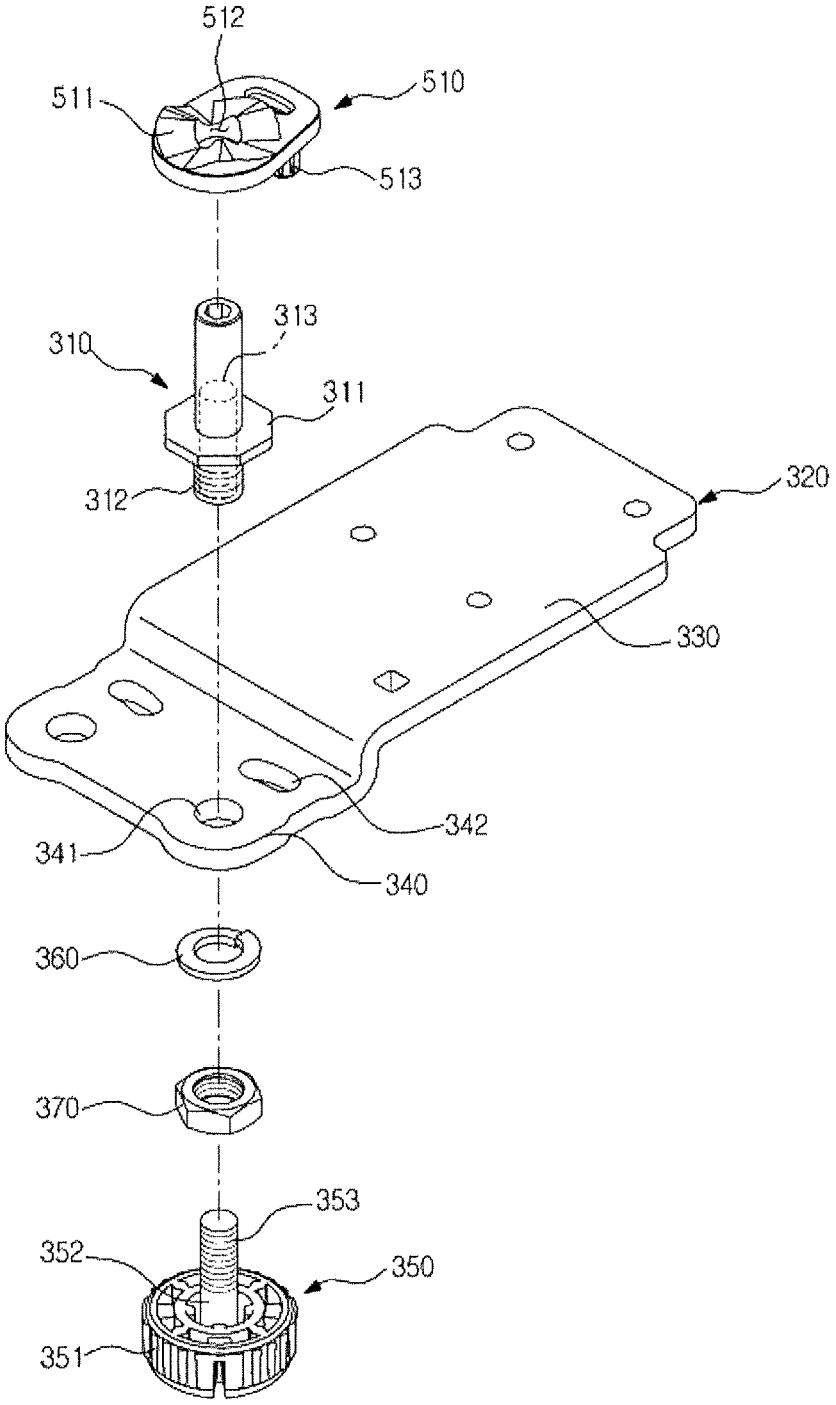
FIG. 7 is an exploded perspective view showing a first lower hinge of a refrigerator according to one or more embodiments, such as the refrigerator of FIG. 1.
Figure 8:
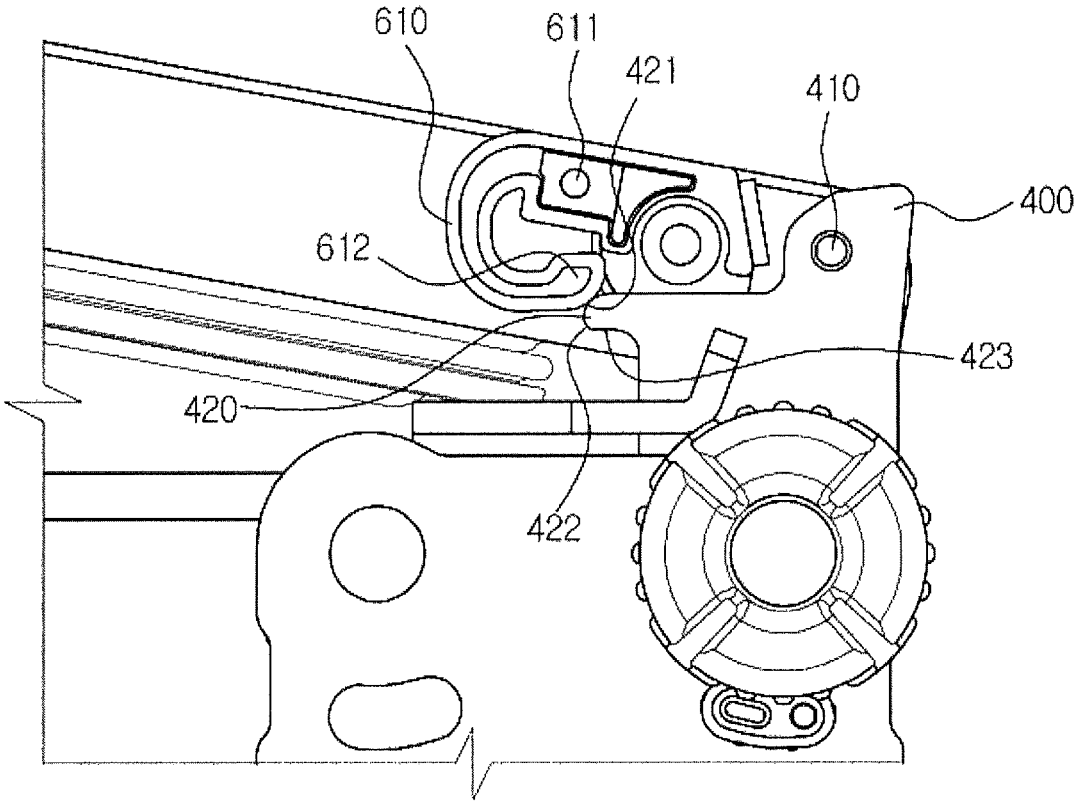
FIGS. 8 to 10 are views illustrating an operation of an auto closure of a second door of a refrigerator according to one or more embodiments, such as the refrigerator of FIG. 1.
Figure 9:
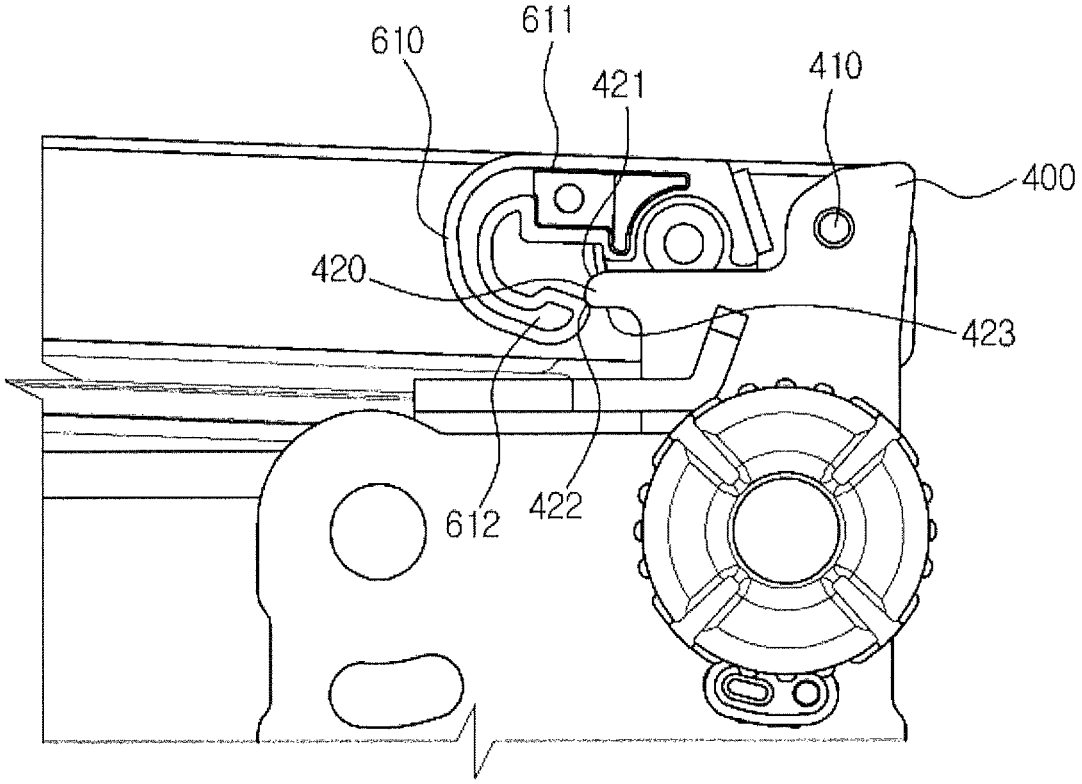
Figure 10:
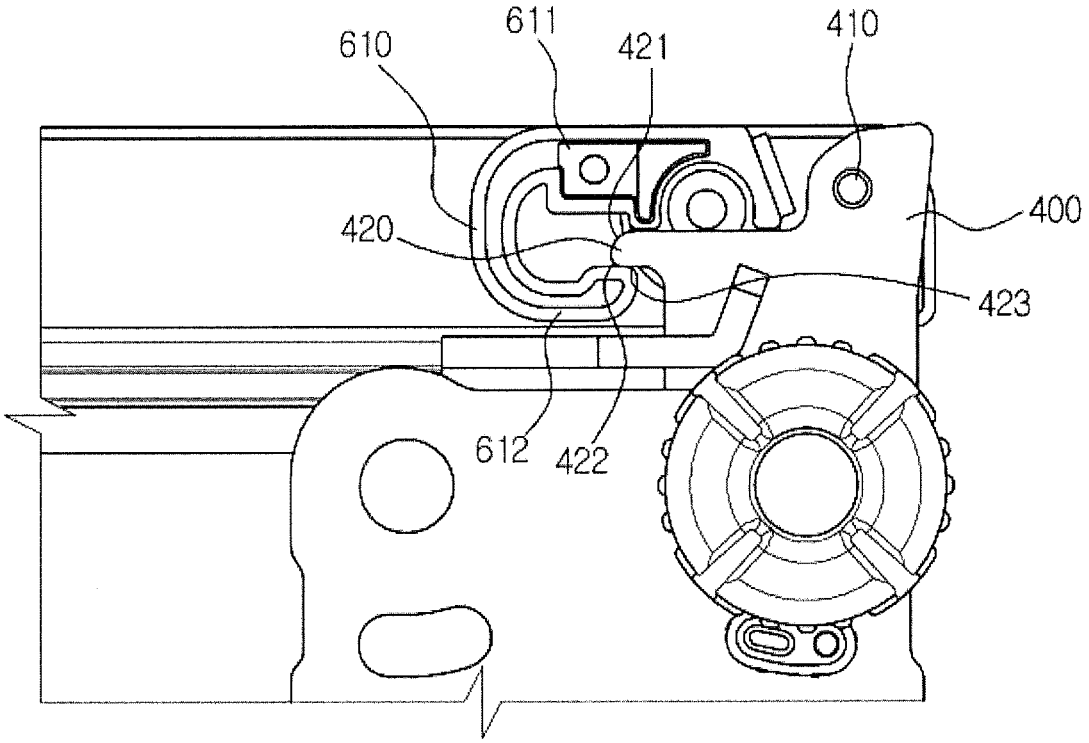

FIG. 5 shows first and second upper hinges of a refrigerator according to one or more embodiments, such as the refrigerator of FIG. 1, and FIG. 6 shows first and second lower hinges of a refrigerator according to one or more embodiments, such as the refrigerator of FIG. 1. FIG. 7 is an exploded perspective view showing a first lower hinge of a refrigerator according to one or more embodiments, such as the refrigerator of FIG. 1. FIGS. 8 to 10 are views illustrating an operation of an auto closure of a second door of a refrigerator according to one or more embodiments, such as the refrigerator of FIG. 1.

As shown in FIGS. 5 to 7, the first upper hinge 100, the first lower hinge 300, the second upper hinge 200, and the second lower hinge 400 may be coupled to an upper face of the main body 10, a lower face of the main body 10, an upper face of the first door 50, and a lower face of the first door 50 by fastening members, respectively. Thus, the fastening members may be disassembled, and thereby the first upper hinge 100, the first lower hinge 300, the second upper hinge 200, and the second lower hinge 400 may be separated.

The first upper hinge 100 may include a first upper hinge shaft 110 that may be inserted into an upper hinge hole 55 of the first door 50 so as to rotatably support the first door 50. The second upper hinge 200 may include a second upper hinge shaft 210 that may be inserted into an upper hinge hole 75 of the second door 70 so as to rotatably support the second door 70.

The first lower hinge 300 may include a first lower hinge shaft 310 that may be inserted into a lower hinge hole 56 of the first door 50 so as to rotatably support the first door 50. The second lower hinge 400 may include a second lower hinge shaft 410 inserted into a lower hinge hole 76 of the second door 70 so as to rotatably support the second door 70.

The first upper hinge shaft 110 and the first lower hinge shaft 310 may be provided on the same axis, and the second upper hinge shaft 210 and the second lower hinge shaft 410 may also be provided on the same axis. The first upper hinge shaft 110 and the first lower hinge shaft 310 may be not provided on the same axis as the second upper hinge shaft 210 and the second lower hinge shaft 410.

Meanwhile, the refrigerator according to one or more embodiments may include a first auto closure 500 that may rotate the first door 50 in a direction in which the first door 50 is closed when the first door 50 is closed at a predetermined angle or more and a second auto closure 600 that may rotate the second door 70 in a direction in which the second door 70 is closed when the second door 70 is closed at a predetermined angle or more.

Here, the first auto closure 500 may include a first cam member 510 having a first cam face 511 inclinedly formed so as to move up and down in a circumferential direction and a second cam member 520 having a second cam face 521 inclinedly formed so as to correspond to the first cam face 511.

In this case, the first cam member 510 may be coupled to the upper face of the first lower hinge 300, and the second cam member 520 may be coupled to the lower face of the second lower hinge 400. The first cam member 510 may include a through-hole 512 through which the first lower hinge shaft 310 may pass and an anti-rotation bar 513 that mat prevent co-rotation when the first lower hinge shaft 310 is rotated.

With this configuration, the first auto closure 500 may rotate the first door 50 using gravity with which the second cam face 521 slides along the first cam face 511.

Meanwhile, the second auto closure 600 may include an elastic lever 610 that accumulates an elastic force while the second door 70 is being closed and forces the accumulated elastic force to rotate the second door 70 in a closed direction when the second door 70 is closed at a predetermined angle or more.

Here, the elastic lever 610 may be coupled to the lower face of the second door 70 so as to be elastically deformed under pressure by the second lower hinge 400 while the second door 70 is being closed.

The elastic lever 610 may have a stationary end 611 whose position may be fixed and a movable end 612 whose position may vary and may be provided in an approximate U shape. The elastic lever 610 may be elastically deformed so that a distance between the stationary end 611 and the movable end 612 is increased or decreased. The second lower hinge 400 may be formed with a pressurizing protrusion 420 protruding so as to pressurize the elastic lever 610.

As shown in FIGS. 8 to 10, the pressurizing protrusion 420 may have a first face 421, a turning point 422, and a second face 423 in the order in which it may meet the movable end 612 of the elastic lever 610 while the second door 70 is being closed.

As shown in FIG. 9, the elastic lever 610 may be widened when the movable end 612 passes the turning point 422 and accumulates an elastic force. Then, after the movable end 612 passes the second face 423, the elastic lever 610 may rotate the second door 70 in the closed direction with the accumulated elastic force.

Meanwhile, in the refrigerator according to one or more embodiments, a supporting shaft 352 of a supporting leg 350 may be provided on the same axis as the first lower hinge shaft 310 so as to prevent the first lower hinge 300 from sagging by the weight of the first door 50 and the foodstuffs stored in the door pockets 53 of the first door 50.

In detail, as shown in FIG. 7, the first lower hinge 300 may include a hinge plate 320 having a fixing part 330 that may be coupled to the lower face of the main body 10 and an extending part 340 that may extend to a lower side of the first door 50, and the first lower hinge shaft 310 that may be coupled to the extending part 340 of the hinge plate 320 and may be inserted into a lower portion of the first door 50 so that the first door 50 may be rotated. Here, the first lower hinge shaft 310 may be provided with a flange 311 which may extend in a radial direction and to which a load of the first door 50 may be transmitted. This first lower hinge shaft 310 may be integrally formed.

The hinge plate 320 may be provided with a coupling hole 341 to which the first lower hinge shaft 310 may be screwed and an anti-rotation bar coupling hole 342 into which the anti-rotation bar 513 of the first cam member 510 may be fitted.

The first lower hinge shaft 310 may be screwed to the coupling hole 341 of the hinge plate 320 so as to move up and down and be coupled with a washer 360 and a nut 370 so as to be prevented from being unscrewed.

Further, the supporting leg 350 of the first lower hinge 300 may include a supporting cap 351 that may be in contact with a floor on which the refrigerator is installed and a supporting shaft 352 that may extend vertically from the supporting cap 351 and may be axially coupled to the first lower hinge shaft 310. Here, the supporting shaft 352 may be screwed to the first lower hinge shaft 310 in an axial direction.

That is, a female thread part 313 may be formed on an inner circumferential surface of the first lower hinge shaft 310, and a male thread part 353 screwed to the female thread part 313 of the first lower hinge shaft 310 may be formed on an outer circumferential surface of the supporting shaft 352.

Thereby, a height of the first door 50 may be adjusted by changing an amount by which the supporting shaft 352 is screwed to the first lower hinge shaft 310. Further, the supporting leg 350 may be replaced by separation from the first lower hinge shaft 310.

Further, the load of the first door 50 which may be applied to the first lower hinge shaft 310 may be transmitted to the floor via the supporting leg 350 coupled to the first lower hinge shaft 310. As such, the sagging of the hinge plate 320 may be prevented.

Figure 11:
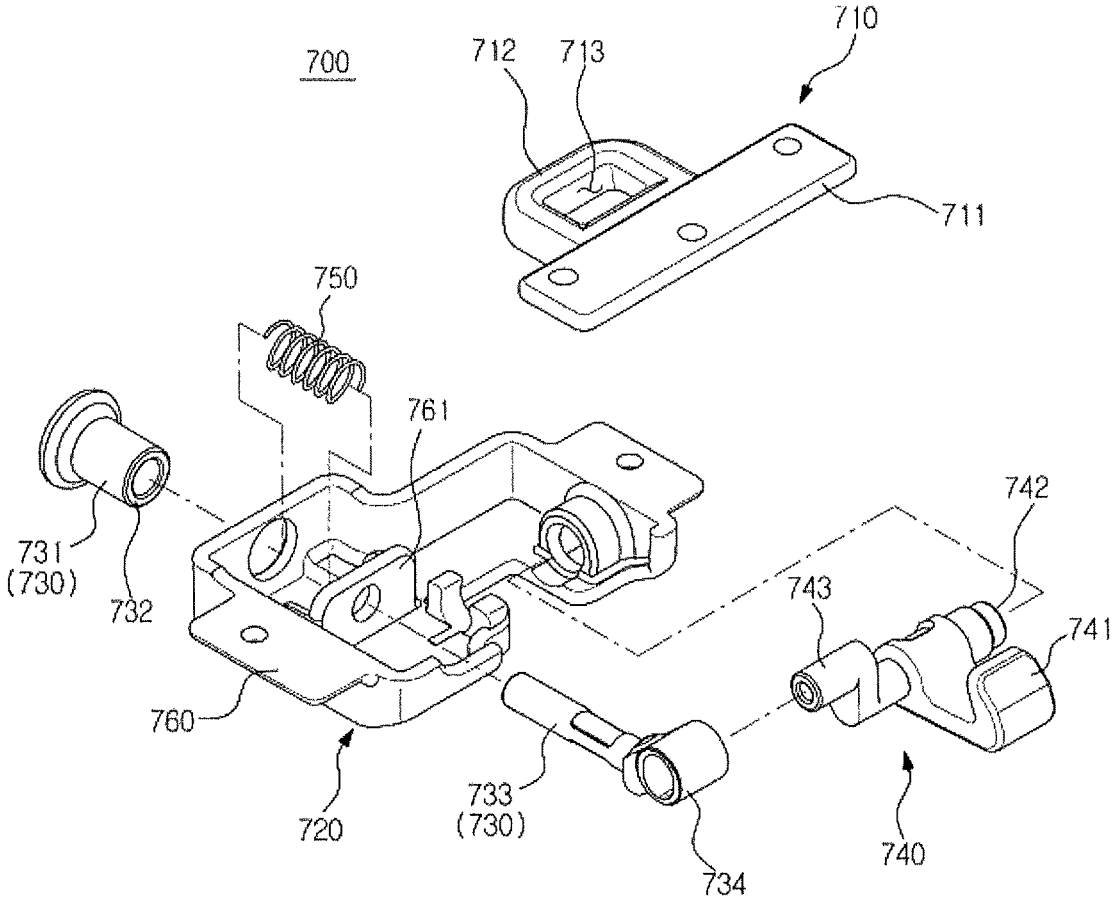
FIG. 11 is an exploded perspective view of a door anti-opening unit of a refrigerator according to one or more embodiments, such as the refrigerator of FIG. 1.
Figure 12:
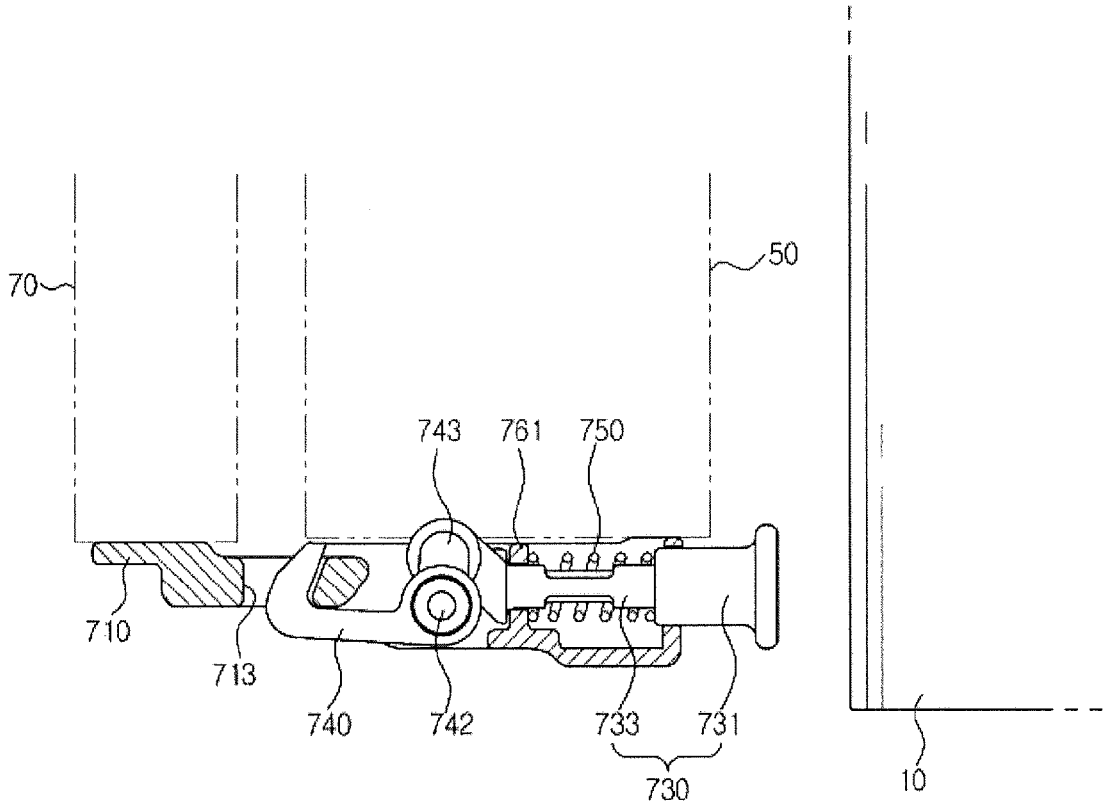
FIGS. 12 and 13 are views illustrating an operation of a door anti-opening unit of a refrigerator according to one or more embodiments, such as the refrigerator of FIG. 1.
Figure 13:
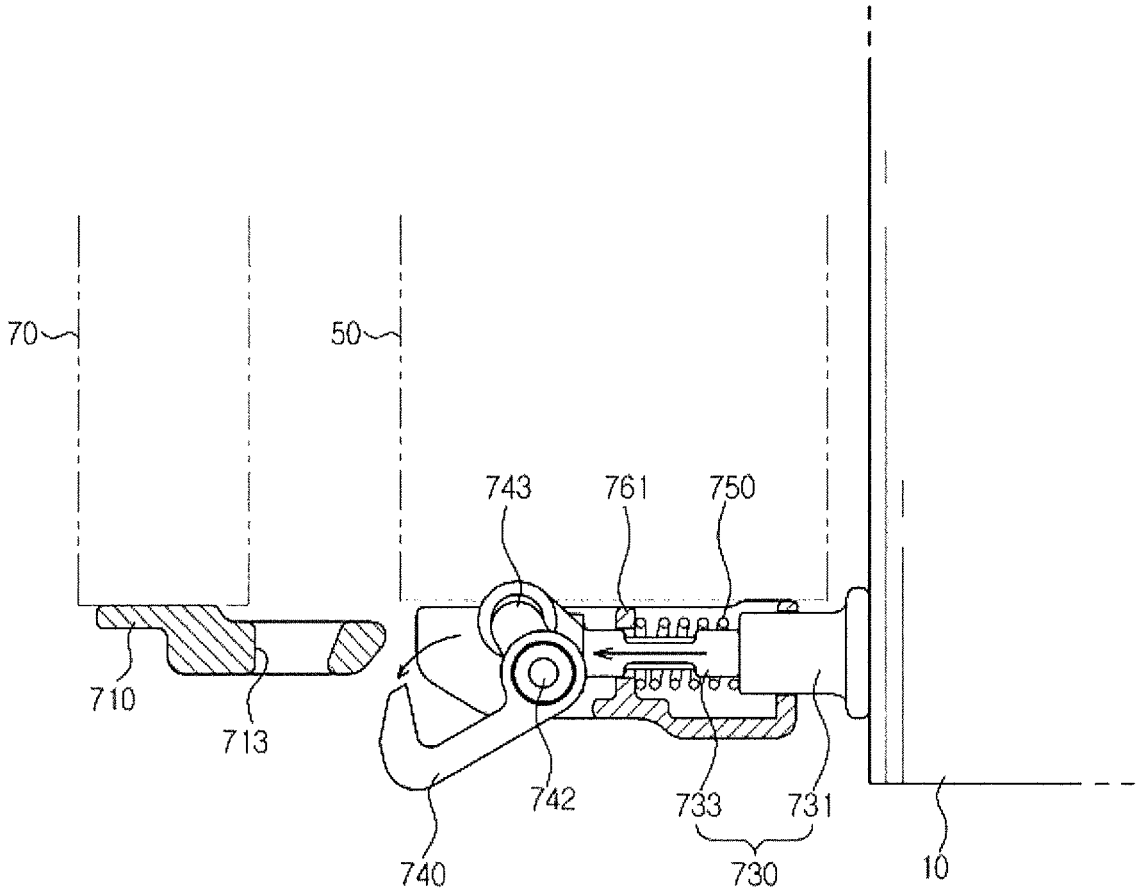

FIG. 11 is an exploded perspective view of a door anti-opening unit of a refrigerator according to one or more embodiments, such as the refrigerator of FIG. 1. FIGS. 12 and 13 are views illustrating an operation of a door anti-opening unit of a refrigerator according to one or more embodiments, such as the refrigerator of FIG. 1.

As described above, the door anti-opening unit 700 may allow the second door 70 to be opened in the state in which the first door 50 is closed and may prevent the second door 70 from being opened in the state in which the first door 50 is opened.

As shown in FIGS. 11 to 13, the door anti-opening unit 700 may include a striker 710 that may be coupled to the lower face of the second door 70 and a latch 720 that may be coupled to the lower face of the first door 50 and may be latched on or unlatched from the striker 710 depending on whether the first door 50 is opened or closed.

Here, the latch 720 may include a working bar 730 that may be pressurized by the main body 10 and may perform a linear motion, a rotating bar 740 that may be rotated in cooperation with the linear motion of the working bar 730 and may be provided with a hook 741 at one end thereof, and a restoring spring 750 that may restore the working bar 730 to its original position when pressurization of the main body 10 against the working bar 730 is released.

Here, the working bar 730 may include a head part 731 on which the pressurization of the main body 10 directly acts and a body part 733 coupled to the head part 731. The head part 731 may be provided with a supporting face 732 supporting the restoring spring 750.

Further, the rotating bar 740 may include a rotational shaft 742 that may act as the center of rotation and a connecting shaft 743 that may be coupled to the working bar 730, may receive a driving force from the working bar 730, and may be provided so as to be parallel with the rotational shaft 742. The working bar 730 may be provided with a connecting hole 734. The connecting shaft 743 of the rotating bar 740 may be rotatably inserted into the connecting hole 734.

Further, the door anti-opening unit 700 may further include a housing 760 that may accommodate the working bar 730, the rotating bar 740, and the restoring spring 750. The housing 760 may be coupled to the lower face of the first door 50 by a fastening member. The housing 760 may have a supporting wall 761 that supports the restoring spring 750.

Meanwhile, the striker 710 may include a coupling plate 711 that may be coupled to the lower face of the second door 70 and an arm bar 712 that may be formed in a ring shape and may have a coupling hole 713 into which the hook 741 of the latch 720 may be inserted. The coupling plate 711 may be coupled to the lower face of the second door 70 by a fastening member. The striker 710 may be integrally formed, for example, of a steel material.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A refrigerator comprising:

a main body having a storage compartment;

a first door that is rotatably provided in the front of the main body to open/close the storage compartment, the first door having an opening in which at least one door pocket is provided;

a second door that is rotatably provided in the front of the first door to open/close the opening, the second door being rotated in the same direction as a rotating direction of the first door; and a door anti-opening unit that prevents or allows opening of the second door depending on whether the first door is opened or closed, the door anti-opening unit including:

a latch that is coupled to a lower face of the first door, wherein the latch includes:

a working bar that is pressurized by the main body and performs a linear motion, and a rotating bar that is rotated in cooperation with the linear motion of the working bar, the rotating bar including a rotational shaft acting as a center of rotation and a connecting shaft, which is integrally formed with and connected to the rotational shaft, offset from the center of rotation, wherein the working bar is rotatably coupled to the connecting shaft.

2. The refrigerator according to claim 1, wherein the door anti-opening unit allows the second door to be opened in a state in which the first door is closed and prevents the second door from being opened in a state in which the first door is opened.

3. The refrigerator according to claim 1, wherein the door anti-opening unit includes a striker coupled to a lower face of the second door, and wherein the latch is latched on or unlatched from the striker depending on whether the first door is opened or closed.

4. The refrigerator according to claim 3, wherein the rotating bar has a hook at one end thereof, and the latch further includes a restoring spring that restores the working bar to its original position when pressurization of the main body against the working bar is released.

5. The refrigerator according to claim 4, wherein the connecting shaft is connected to the working bar, receives a driving force from the working bar, and is provided so as to be parallel with the rotational shaft.

6. The refrigerator according to claim 5, wherein the working bar includes a connecting hole into which the connecting shaft of the rotating bar is rotatably inserted.

7. The refrigerator according to claim 4, wherein the door anti-opening unit includes a housing that accommodates the working bar, the rotating bar, and the restoring spring.

8. The refrigerator according to claim 7, wherein the housing is coupled to the lower face of the first door by a fastening member.

9. The refrigerator according to claim 3, wherein the striker includes a coupling plate coupled to the lower face of the second door and an arm bar formed in a ring shape.

10. The refrigerator according to claim 9, wherein the coupling plate is coupled to the lower face of the second door by a fastening member.

11. The refrigerator according to claim 3, wherein the striker is integrally formed of a steel material.

12. The refrigerator according to claim 1, wherein the working bar includes a connecting hole in which the connecting shaft is rotatably coupled to the connecting hole.

13. The refrigerator according to claim 1, wherein the working bar is pressurized by the main body when the first door is closed, and wherein the rotating bar engages the second door when the first door is open.

14. A refrigerator comprising:

a main body having a storage compartment;

a first door that is rotatably provided in the front of the main body, opens/closes the storage compartment, and has an opening in which at least one door pocket is provided;

a second door that is rotatably provided in the front of the first door, opens/closes the opening, and is rotated in the same direction as a rotating direction of the first door;

a first gasket that is provided on a rear face of the first door so as to maintain airtightness between the main body and the first door and has a first magnet drawing the main body; and a second gasket that is provided on a rear face of the second door so as to maintain airtightness between the first door and the second door and has a second magnet drawing the first door; and a door anti-opening unit including a latch that is coupled to a lower face of the first door, the latch including:

a working bar is pressurized by the main body when the first door is closed and performs a linear motion, and a rotating bar that is rotated in cooperation with the linear motion of the working bar, the rotating bar including a rotational shaft acting as a center of rotation and a connecting shaft, which is integrally formed with and connected to the rotational shaft, offset from the center of rotation, wherein the connecting hole of the working bar is rotatably coupled to the connecting shaft.

15. The refrigerator according to claim 14, wherein the main body includes an outer case, and the outer case of the main body and a front face of the first door are formed of a steel material so as to be drawn by the first magnet and the second magnet, respectively.

16. The refrigerator according to claim 14, wherein door anti-opening unit that prevents the second door from being unintentionally opened by inertia occurring when the first door is opened.

17. The refrigerator according to claim 14, wherein a first magnetic force with which the first magnet draws the main body is stronger than a second magnetic force with which the second magnet draws the first door.

18. The refrigerator according to claim 14, wherein the working bar includes a connecting hole in which the connecting shaft is rotatably coupled to the connecting hole.

19. The refrigerator according to claim 14, wherein the working bar is pressurized by the main body when the first door is closed, and wherein the rotating bar engages the second door when the first door is open.

* * * * *